United States Patent [19]

Korting et al.

[11] 3,977,824

[45] Aug. 31, 1976

[54] TRAVELLING HEARTH HOUSING

[75] Inventors: Reinhard Korting; Ingo Thiesler, both of Neubeckum, Germany

[73] Assignee: Polysius AG, Neubeckum, Germany

[22] Filed: Apr. 7, 1975

[21] Appl. No.: 565,630

[30] Foreign Application Priority Data

Apr. 17, 1974 Germany ..... 2418553

[52] U.S. Cl. ..... 432/251; 432/245

[51] Int. Cl.[2] ..... F27D 1/00

[58] Field of Search ..... 432/127, 245, 251; 266/21

[56] References Cited

UNITED STATES PATENTS

| | | | |
|---|---|---|---|
| 1,348,408 | 8/1920 | Greenawalt | 266/21 X |
| 3,281,229 | 10/1966 | McMaster | 432/245 X |
| 3,322,417 | 5/1967 | Mitchell | 432/251 X |

*Primary Examiner*—John J. Camby

[57] ABSTRACT

A housing for a travelling hearth has longitudinally spaced vertical columns which support a plurality of horizontal beams and housing sheets. Some of the beams are subjected to higher temperature loading than are others. Those beams that are subjected to lower temperature loading are fixed to each column whereas those that are subjected to higher temperature loading are fixed only to every second column and are slidably connected to the intermediate columns.

7 Claims, 3 Drawing Figures

TRAVELLING HEARTH HOUSING

This invention relates to a housing of a travelling hearth used for the heating and cooling of material, and comprising vertical columns, a first group of longitudinal beams of low temperature loading, a second group of longitudinal beams of high temperature loading, and housing sheets.

Depending on the particular application, temperatures of 900°–1200°C. prevail in the upper part of the housing of a travelling hearth. In spite of the refractory cladding provided on the inside of the housing sheets, these sheets together with the longitudinal beams bolted thereto (hereinafter called the "second group of longitudinal beams") heat up to temperatures of as much as about 200°C. Other longitudinal beams (hereinafter called the "first group of longitudinal beams") which are attached to the outer edges of the vertical columns at a greater distance from the sheet metal housing, remain however relatively cool.

With previously known constructions, some pairs of vertical columns are usually fixedly connected to the foundation, in the centre of the hearth, while all the other vertical columns are slidably anchored to the foundation, so that they can move on said foundation during axial extension of the travelling hearth.

However this method of accommodating thermal expansions involves various disadvantages.

Since the cold longitudinal beams of the first group do not heat up as much as the longitudinal beams of the second group, stresses and deformation occur in the frame-work of the travelling hearth. Since the vertical columns are also heavily loaded in the vertical direction, very large forces must arise in the horizontal direction to move the feet of the columns in the sliding anchorage. Since the maximum thermal expansions occur in the upper part of the hearth, the columns are often not moved but become tilted, which results in changes in the dimensional system of the travelling hearth.

Under irregular heating of the two sides of the hearth (caused for example by additional cooling of the outer surfaces of the hearth on the wind side), known travelling hearths can in some cases assume a curved shape. The deviations from the theoretical centre line in the longitudinal direction may be so considerable in such a case that the travelling hearth chain runs laterally towards the housing wall or the lateral chain sealing elements, and this can lead to serious interruptions to operation.

The invention therefore has for its objective the avoidance of these disadvantages while providing a housing for a travelling hearth wherein the thermal expansions in the individual components due to temperature loading can be effectively accommodated without any danger of undesired stresses and deformation.

According to the invention this objective is achieved in that the vertical columns fixedly attachable to the foundation are fixedly connected to all the longitudinal beams of the first group, while the longitudinal beams of the second group and the housing sheets are only fixedly attached to some of the vertical columns and are slidably connected to the others.

With a hearth housing of this type all the sheet metal parts and beams which undergo appreciable temperature loading can expand freely within a rigid cold hearth frame formed of the vertical columns and the longitudinal beams of the first group. Thus differential thermal expansions on the two sides no longer have any effect on the centre axis of the hearth. Similarly, undesired stresses and deformations caused by different thermal expansions are avoided.

These and further features of the invention will appear from the appended claims and the following description of one embodiment of the invention as shown in the drawings, wherein:

Figure 1:
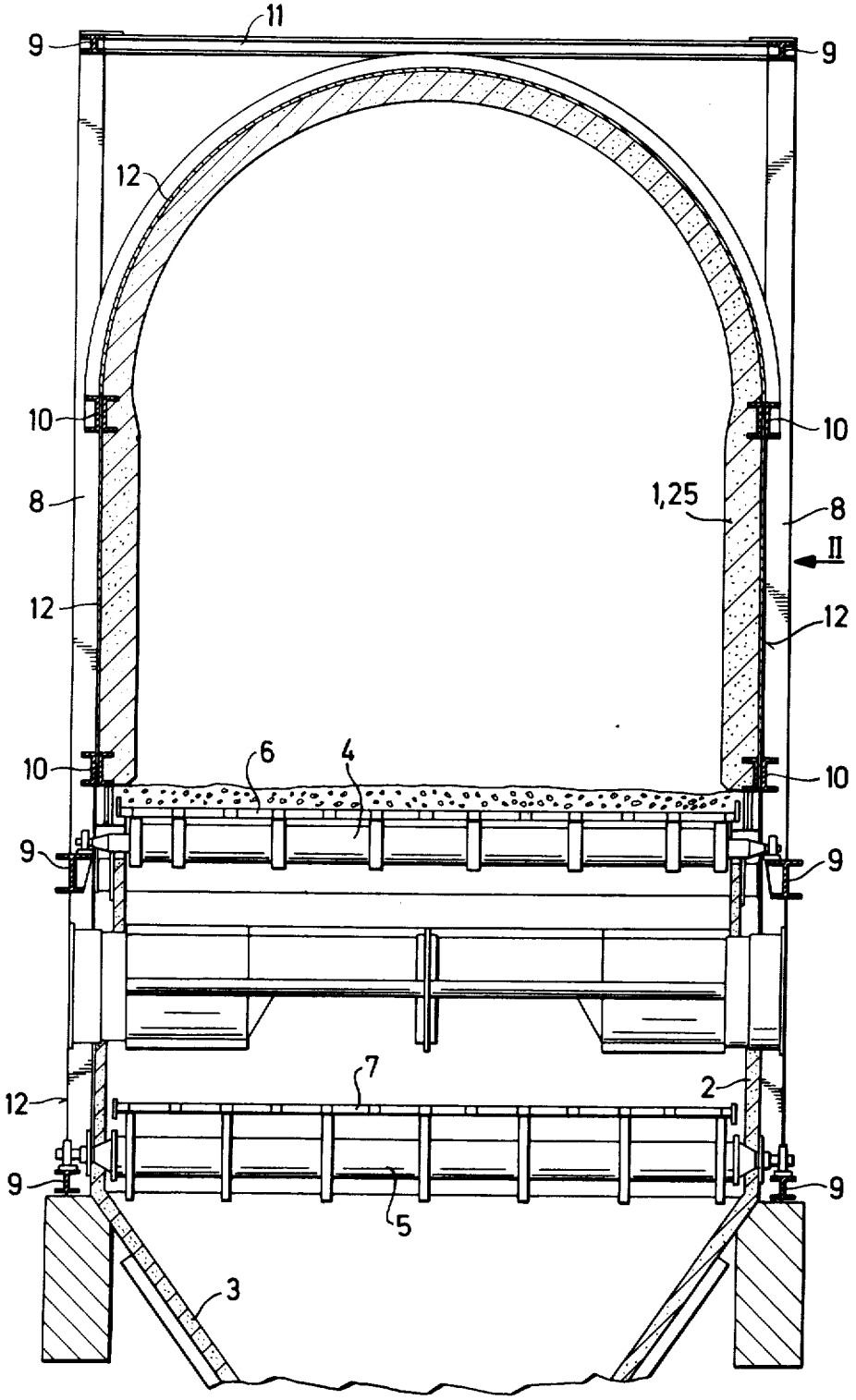
FIG. 1 is a cross-section through a travelling hearth housing.

The travelling-hearth housing shown in FIG. 1 comprises an upper housing portion 1, a lower housing portion 2, and a dust chamber 3. The upper housing portion 1, the lower housing portion 2 and the dust chamber 3 are lined with refractory material.

In the hearth housing are the upper support track axis 4 and the lower support track axis 5, over which run the upper reach 6 and the lower reach 7 of the hearth chain.

The hearth housing also comprises vertical columns 8 which are joined together by a first group of longitudinal beams 9 and a second group of longitudinal beams 10, also by transverse beams 11.

The longitudinal beams 10 which are joined to the housing sheet 12 are subjected to relatively high temperature loading during operation. The longitudinal beams 9 however are affixed at a greater distance from the sheet metal housing and therefore remain relatively cold.

Figure 2:
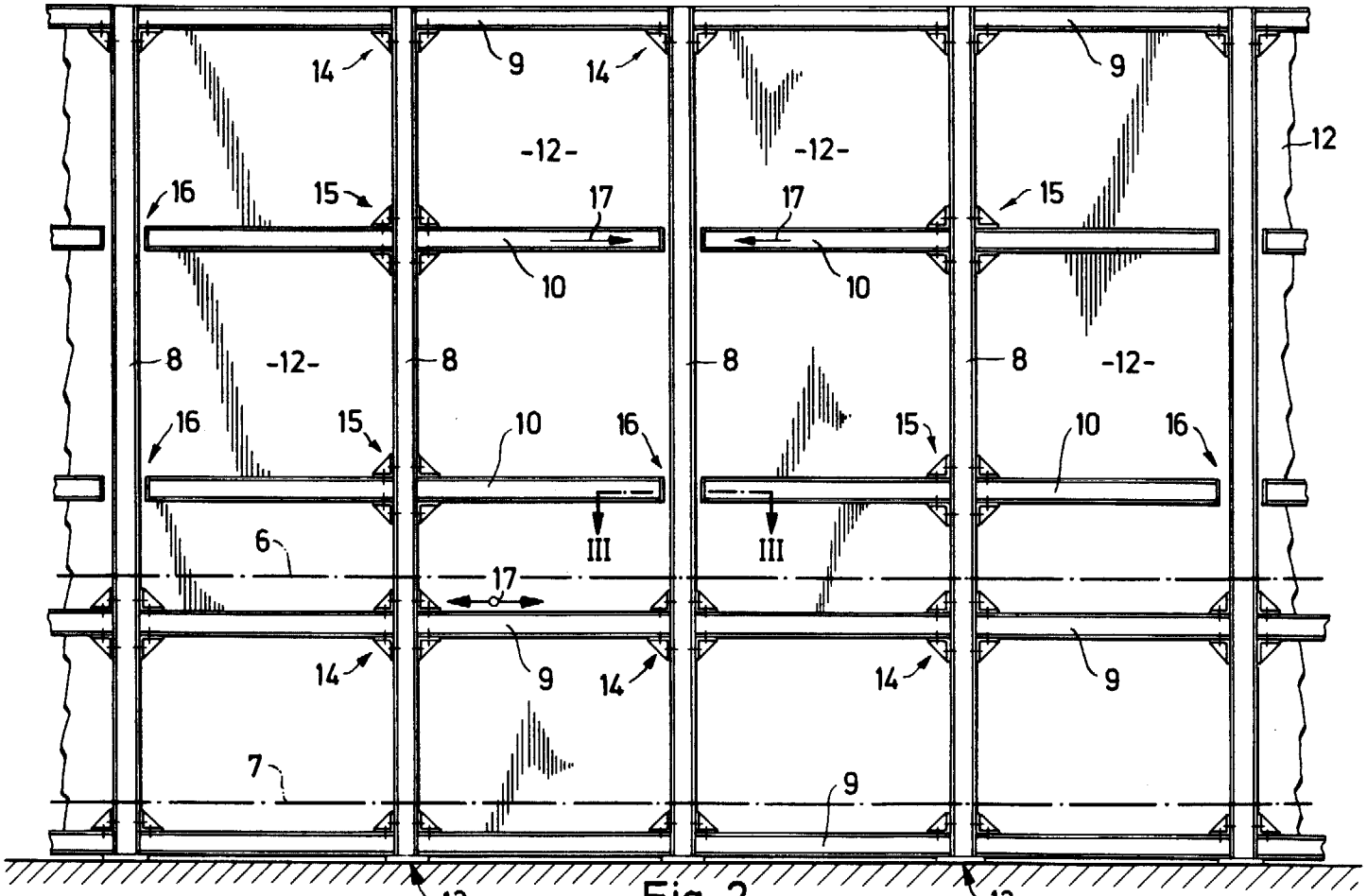
FIG. 2 is a side-view of the travelling-hearth housing provided by the invention, as viewed in the direction of the arrow II in FIG. 1.

FIG. 2 shows in detail the construction of the hearth housing in accordance with the invention.

The vertical columns 8 are all fixedly attached to the foundation (anchorage 13 by bolting).

The relatively cold longitudinal beams 9 of the first group are rigidly attached to all the vertical columns 8 (bolting 14).

The longitudinal beams 10 of the second group, which together with the housing sheets 12 bonded thereto are subject to relatively high temperature loading during operation, are only rigidly attached to some of the vertical columns 8, in particular to every second vertical column (bolting 15). The longitudinal beams 10 are however slidably connected to all the other vertical columns 8 (sliding bolt joints 16). In this way the hot longitudinal beams 10 and the equally hot housing sheets 12 can freely extend over sections 5 meters long (with the vertical columns spaced at for instance 25 meter intervals) — see the thermal expansion arrows 17.

Figure 3:
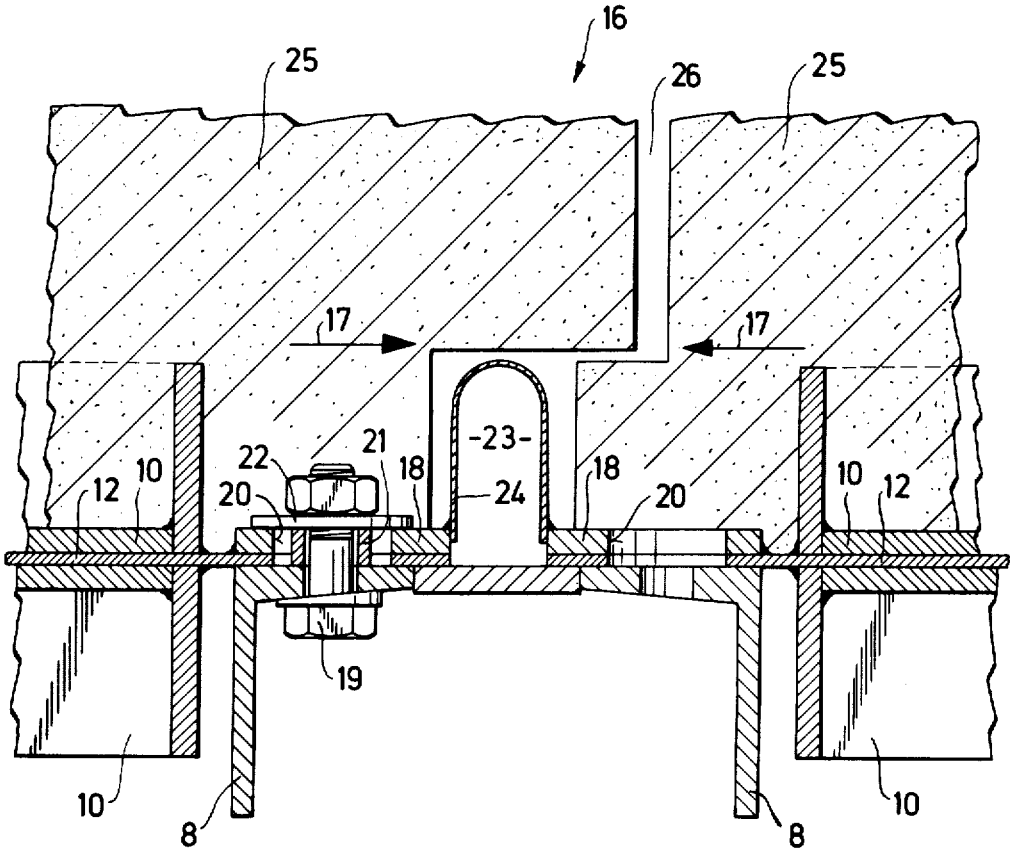
FIG. 3 is a section through a sliding joint position and taken on the line III—III of FIG. 2.

FIG. 3 shows a sliding bolt joint 16 between a vertical column 8 and two longitudinal beams 10. The longitudinal beams 10 are rigidly attached, e.g. by welding, to the housing sheets 12 and the support plates 18. Bolts 19 are passed through aligned holes 20 in the members 8 and 18 which provide sufficiently large play to enable the longitudinal beams 10 to expand in the direction of the arrows 17. Spacer tubes 21 between the vertical columns 8 and the washer 22 ensure a free sliding movement of the longitudinal beam 10 relative to the vertical column 8.

The expansion gap 23 between the housing sheets is externally sealed in gas-tight manner by a welded-in sheet metal compensator 24. The refractory lining 25 also has an expansion gap 26 in the vicinity of the sliding bolt joint.

What is claimed is:

1. In a housing for a travelling hearth having a plurality of longitudinally spaced vertical columns, a first group of horizontal beams of relatively low temperature loading, a second group of horizontal beams of relatively high temperature loading, and housing sheets carried by said beams, the improvement comprising means fixedly connecting the beams of said first group to all of said columns; means fixedly connecting the beams of said second group to alternate ones of said columns; and means slidably connecting the beams of said second group to the remainder of said columns.

2. A construction according to claim 1 including refractory lining means carried by said housing sheets, and wherein the lining means has expansion gaps in the vicinity of those columns to which the beams of said second group are slidably connected.

3. A construction according to claim 2 including sealing means occupying said gaps.

4. A construction according to claim 1 wherein the slidable connecting means comprises slidable bolt joints between said remaining columns and the beams of said second group.

5. A construction according to claim 4 wherein each of said bolt joints comprises aligned openings in said remaining columns and in the beams of said second group, and a bolt extending through said openings, at least one of said openings having a size greater than that of said bolt.

6. A construction according to claim 5 including a spacer encircling said bolt and located in said one of said openings.

7. In a housing for a travelling hearth having a plurality of longitudinally spaced vertical columns, a first group of horizontal beams, a second group of horizontal beams, said first and second groups of horizontal beams being positioned at different vertical levels so as to be subjected to relatively lower and relatively higher temperature loadings, and housing sheets carried by said beams, the improvement comprising means fixing the beams of the relatively lower temperature loading group of beams to all of said columns; means fixing some but less than all of the beams of the relatively higher temperature loading group of beams to all of said columns; and means slideably connecting the beams of the relatively higher temperature loading group of beams to the remainder of said columns.

* * * * *